United States Patent [19]

Rochon

[11] 3,971,139

[45] July 27, 1976

[54] PROCESS AND APPARATUS FOR DECREASING MOISTURE CONTENT IN WOOD

[76] Inventor: Marcel A. Rochon, 11 Forestier St., St.-Jean, Quebec, Canada, J3B 4P4

[22] Filed: Feb. 10, 1975

[21] Appl. No.: 548,391

Related U.S. Application Data

[63] Continuation-in-part of Ser. No. 397,407, Sept. 14, 1973, abandoned.

[52] U.S. Cl. ..... 34/13.8; 34/16.5; 34/30; 34/36; 34/48; 34/51

[51] Int. Cl.[2] ..... F26B 7/00

[58] Field of Search ..... 34/9.5, 13.4, 13.8, 34/16.5, 30, 36, 37, 48, 51

[56] References Cited

UNITED STATES PATENTS

| | | | |
|---|---|---|---|
| 1,413,018 | 4/1922 | Fujino | 34/13.4 X |
| 1,760,444 | 5/1930 | Secord | 34/30 |
| 2,535,925 | 12/1950 | Hudson | 34/16.5 |
| 3,131,034 | 4/1964 | Marsh | 34/30 |

*Primary Examiner*—John J. Camby
*Attorney, Agent, or Firm*—Roland L. Morneau

[57] ABSTRACT

A process and an apparatus for decreasing the moisture content in wood which comprises the step of maintaining the wood in a vapor atmosphere made essentialy from sap until the center of the wood has substantially reached the temperature of the vapor, then gradually raising the temperature of the vapor atmosphere to a degree and during a time sufficient to bake the resinous substances inside the wood and reduce the moisture content to a predetermined percentage and subsequently reducing gradually the temperature of the housing to the temperature of the vapor, wherein the vapor is maintained during the process at a pressure slightly above the atmospheric pressure. The wood boards are disposed vertically to form vertical channels and the source of heat is located to obtain a vertical circulation of the vapor through the boards.

13 Claims, 6 Drawing Figures

PROCESS AND APPARATUS FOR DECREASING MOISTURE CONTENT IN WOOD

Figure 1:
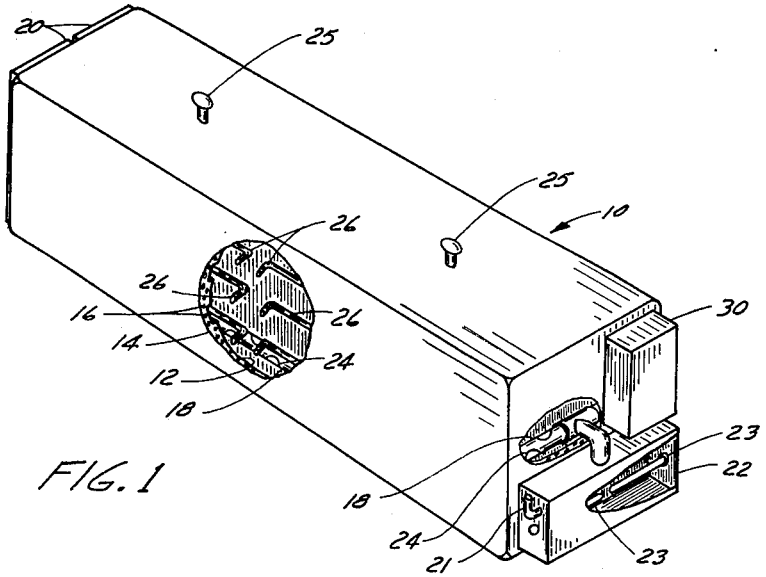

This application is a Continuation-In-Part of original application Ser. No. 397,407 filed on Sept. 14, 1973, now abandoned.

The present invention relates to a process and an apparatus for quickly reducing the moisture in wood and particularly to a process for lowering the percentage of water in wood while not removing all its natural soluble products.

Many processes have been used in the past to lower quickly the moisture content in wood. Among the latter, a combination of factors were tried such as various sources of heat, vapor, vapor under pressure, vacuum, mechanical pressure, circulation of steam, etc . . . In all these cases, there were always certain disadvantages such as deterioration or weakening of the wood fibre, prohibitive cost, etc . . .

The process according to the present invention contemplates the quick reduction of moisture in wood while improving certain characteristics of the wood while maintaining the cost at a reasonable level. The invention is based on the principle of the elimination of water in wood while keeping, as much as possible, the natural products of the wood such as the ones which are usually eliminated or reduced by evaporation during the known processes.

One of the well known products coming from wood is the sap. An experiment demonstrates that sap placed in a plate will completely evaporate if the evaporation is slow but a syrup will remain in the plate if the evaporation is quick, that is, only the fast evaporating substance will go, such as water. This is the well known process for making maple syrup. The present invention is directly related to this principle which consists in the elimination of water from wood while maintaining its natural products which provide it with a great value.

It is known in the osmosis principle, that it is possible to transfer a product from one enclosure to another one when the concentration in one housing is greater than in the other. Accordingly, a piece of wood which is located in a bath of hot water or vapor will loose the concentrated products located inside the wood because they will migrate towards the water or vapor where they will dissolve. However, if the water or the vapor already contains these migrating products, the wood will very little eliminate the latter.

By association with these scientific theories, the present invention may be explained, but is is essentially due to the results of a large number of experiments.

In fact, it has been observed that the wood processed as stated, according to the invention, had cooked in its resinous products. For example, it is possible to drive a nail adjacent the edge of a board without the latter splitting open. This would have been the case of an ordinary wood which would not have been treated according to the invention. Furthermore, the knots of the treated boards appear to be glued in the board by the resin of the wood. Therefore, boards which would not have been utilized on account of holes due to removed knots now become as resistant as a board without knots.

The process according to the invention is characterized by the warming up of the wood in a vapor atmosphere of concentrated sap slightly above atmospheric pressure until the center of the wood has substantially reached the temperature of the vapor, then by the production of heat so as to raise the temperature of the vapor of the sap slowly so as to cook the resinous products inside the wood and to eliminate a predetermined quantity of humidity, and subsequently by the gradual reduction of the temperature of the vapor of the sap. This is particularly done by increasing the quantity of vapor to maintain the pressure, by supplying heat to gradually increase the temperature of the inside of the housing until the wood has eliminated a predetermined quantity of humidity while maintaining the pressure substantially constant, and by introducing vapor of sap at about 212°F for maintaining the pressure until the temperature inside the housing has reached substantially the temperature of the vapor itself. Subsequently, the wood is considered to have reached the final stage for which it may be brought to the room temperature and to the atmospheric pressure.

Another object of the process of the present invention is to facilitate the natural circulation of the vapor of sap around the wood to be dried.

Vapor tends to rise when it is warmed up and tends to move downwardly when the temperature decreases. Within an enclosure, vapor will circulate in such a cycle so that vapor, where heated, will rise and where cooled, will move downwardly.

In order to facilitate this slow natural circulation process, the wood boards are disposed vertically and spaced apart to form vertical chimney-like channels for the vertical movement of the vapor of sap.

The new invention also comprises an apparatus which is enable to perform the said process. It consists of a housing which can be sealed and in which a concentrated vapor of sap is brought to fill the housing and to maintain a slight pressure above the atmosphere. Furthermore, heating elements are mounted on the internal sidewalls of the housing so as to produce a relatively uniform heat at a desired high temperature which can be varied gradually.

More particularly, the invention is directed to a housing having a rectangular section and having heating electrical elements on both sides, on the floor and on the ceiling. These elements are sufficiently close to maintain the wood at a relatively uniform temperature. A vapor temperature for concentrated sap supplies vapor to a perforated pipe located along the internal wall of the enclosure. Valves allowing a desired pressure are mounted on the enclosure. The heating elements are electrically connected by groups, the elements of each group being preferably spaced around the enclosure so as to supply a uniform heat which may be varied at will within a predetermined range.

Figure 2:
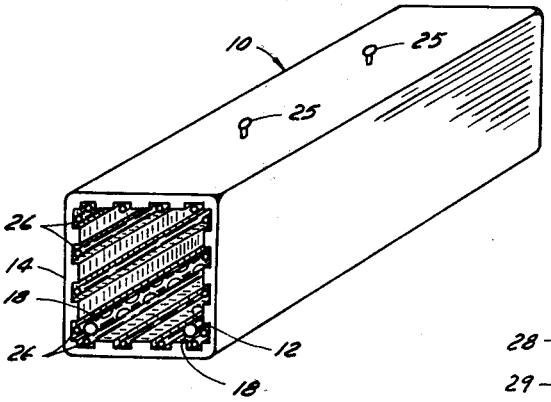
Figure 3:
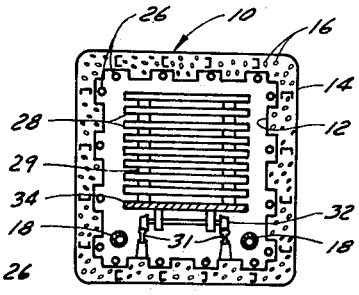
Figure 4:
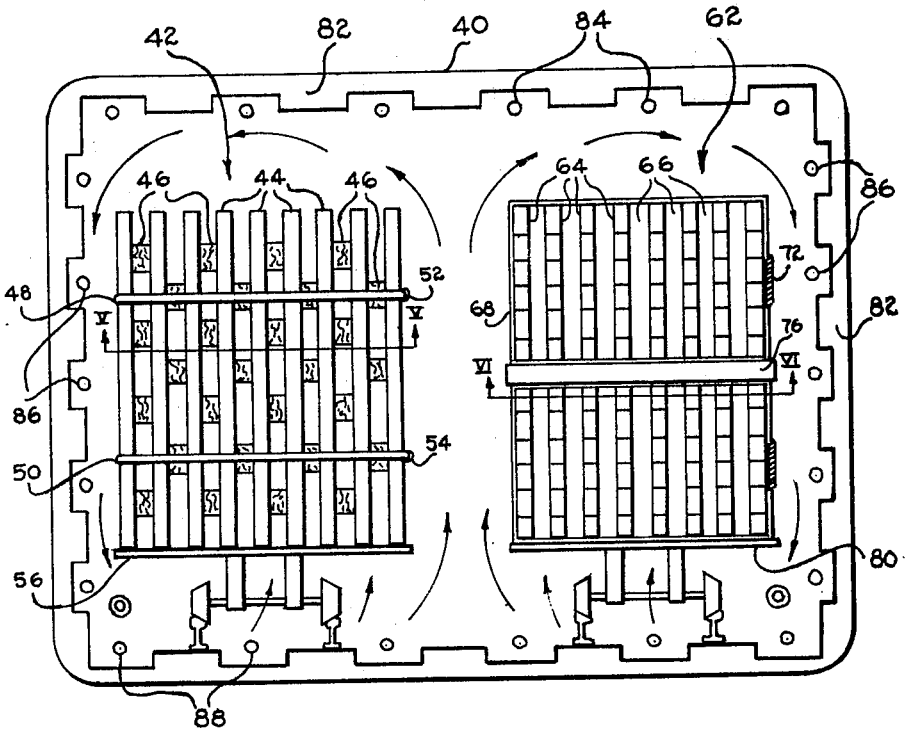
Figure 5:
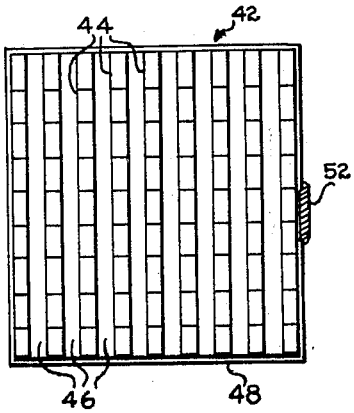
Figure 6:
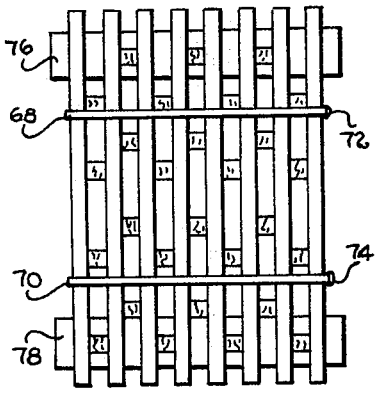

The invention will now be described by referring drawings illustrating a specific embodiment wherein:

FIG. 1 is a perspective view of the container for drying lumber according to the invention, FIG. 2 is a front perspective view of the container with the front doors removed, FIG. 3 is a sectional view of the container in which a load of wood has been introduced, FIG. 4 is a rear end view of the container containing a load of wood stacked vertically, FIGS. 5 and 6 are cross-sectional views along lines V—V and VI—VI of FIG. 4.

Referring to the drawings, the wood drying device comprises a housing or container 10 made of a double wall 12 and 14 insulated with a semi-rigid mineral wool 16. Vapor is fed inside the housing 10 by a pipe 18 surrounding the side portion of the inner wall 12 except in front of the doors 20. The vapor is fed to the pipe 18 by a vapor generator 22 which contains the sap and two immersion heating elements 23 powerful enough to produce the desired vapor. The vapor passes through the apertures 24 provided in the pipe 18 and is expected to reach a pressure of about one pound per square inch. The pressure may be controlled by using only one of the two elements or by varying the wattage in the elements 23 and by the pressure valves 25 mounted on the roof of the housing 10. These valves 25 may be of the counterweight type and shall be particularly adapted to operate within the range of the invention, that is ⅛ to ½ lb/inch square.

The inner wall 12 of the housing is also provided with a plurality of electrical heating elements 26 mounted over the two sides, the bottom and the roof. The elements 26 are spaced over the whole area so as to provide a substantially uniform temperature throughout the lumber 28 piled up inside the housing. (see FIG. 3). The elements 26 are operated by the electrical box 30 so that they may be heated by groups. The elements of each group are spread over the surface of the inner wall 12 so that when only one group is energized, the heat will be as uniform as possible considering the number of elements involved.

One practical embodiment adapted to be commercially used and to be moved on wheels is substantially of the following dimensions:

| | |
|---|---|
| Inner length of the container: | 42 feet |
| Inner width and height of the container: | 10 feet |

The reservoir 22 has an operating capacity of 80 gallons. Its dimensions are approximately 10 feet long, 4 feet high and 2 feet thick. The heating elements 23 are immersed in the sap and are protected by a level float controlling the fuel inlet 21. The vapor is projected in the pipe 18 which has a diameter of 4 inches. The heating elements 26 are of the type that stays rather black even when heated at its maximum temperature. They are located in rows 8 inches apart over the top and the side surfaces and 7 inches apart on the bottom surface. Their diameter is about ½ inch. In this embodiment, 126 heating elements 26 of 20 feet long are used. They are subdivided in 6 groups and each group is controlled separately from the electric box 30. This arrangement enables a better control of the temperature, particularly when the temperature must be raised or lowered.

The bottom surface of the container is provided with rails 30 on which the wheels 32 of a vehicle may rotate. The vehicle has a flat bed 34 on which the lumber 28 is piled up with spacers 29.

In operation, the lumber 28 is introduced into the container 10 as shown in FIG. 3. The doors 20 are closed to form a vapor tight enclosure. The sap contained in the reservoir 22 is heated rapidly by the two heating elements 23 to form vapor which is dissipated through the pipe 18 and the container 10. This is done until the inside temperature of the container is at least 212°F with a pressure of ¼ lb/inch$^2$ above atmospheric pressure. For freshly cut board having a section of 1 inch by 5 inches, it takes from 45 minutes to an hour to reach this temperature at the center of the wood. Some elements 26 are heated to raise the temperature around 300°F during 30 minutes to bring the heart of the lumber to the temperature of the container. At this time, the vapor generator 22 is stopped because the moisture dissipated by the wood is sufficient to maintain the pressure required. At the same time, as the generator 22 is stopped, the elements 26 are heated to raise the temperature to about 500°F. This temperature is maintained during all the period. Some moisture comes out of the wood. This takes about 1½ to 2 hours with the wood mentioned above. At this time, the vapor ceases to come out of the valves 25. During this period the moisture has come out of the wood and the resinous products have cooked so as to plasticize the wood. The lumber then is cooled by stopping the current in the elements 26 and by producing vapor from the generator until the room temperature has nearly reached 212°F. This step enables the periphery of the wood which became dried at 500°F to absorb sap while the temperature lowers so as to regain its desired moisture and prevent cracking. This last step takes from 30 to 45 minutes. The doors 20 of the container may then be opened to remove the lumber from the container.

After the wood has reached the temperature outside the container, its moisture content is tested and indicates from 7 to 12%.

It should be obvious that these various temperatures and durations may vary according to the desired results and the type and original conditions of the wood.

The sap used for similar wood such as pine and spruce may be the same. The sap is obtained from previous batches i.e., recuperated from the valves 25. It is obvious that the liquid used for vapor could be made from the main constituents of sap.

It is interesting to note that board having a section of 2 × 3 inches has lost only 1/32 inch on its width and 1/16 inch on height.

The plasticizing of the wood is particularly demonstrated by passing a nail through a board near the end thereof. Furthermore, the knots appear to be glued or plasticized in the boards.

The fact that a vapor made of sap is used enables the wood to keep a large proportion of its corresponding constituents. It is obvious that a highly concentrated solution of sap instead of pure sap may be used without departing from the purport of the invention.

The holes 24 through which the vapor passes may be sufficiently large so not to produce vapor jet into the container. The present process does not require an activated circulation of vapor caused by these jets because the latter would tend to sip some organic substances out of the wood.

This container is suitable to carry out the whole process wherever it may be connected to a power source of electricity. For this reason, it may be mounted on wheels like a moving van to dry the wood near the forest where it has been cut. This reduces the weight of the lumber which is sent to far away industrial centers. The lost of weight of freshly cut wood is approximately 50%.

In order to improve the drying process, it is useful to prevent stagnation of the vapor of sap in some zones of the container. Accordingly, it is the object of the invention to facilitate the natural circulation of vapor of sap around all the boards of wood. This result may be obtained by a particular disposition of the wood and the sources of heat. This arrangement is illustrated in FIGS. 4, 5 and 6.

The wood drying device is substantially similar to the one shown in FIG. 1 and comprises a container 40 in which are located vertically disposed wood boards which are essentially arranged in two different types. These two types are shown in the same FIG. 4 and in the same enclosure 40 for the purpose of brevity.

The first stack 42 of wood is made of vertically positioned boards 44 spaced apart by spacers 46. The boards 44 illustrated in FIG. 5 are in contact edgewise. In order to keep or to stack the boards 44 in one bundle, a pair of straps 48 and 50 surrounds the bundle. However, in order to take up the normal expansion and contraction, coil springs 52 and 54 are connected to the straps 48 and 50 along the periphery of the bundle so as to make the combined strap and spring linearly resilient. Nevertheless, the tension of the springs should be great enough to counteract the bending tendency of the boards 44. The boards of the stack 42 are usually piled up horizontally, then strapped and finally disposed vertically on a perforated wheeled platform 56.

The second stack 62 is made of boards 64 disposed horizontally lengthwise but vertically edgewise. The boards 64 are disposed edgewise one over the other to form vertical surfaces. The boards 64 forming the said surfaces are separated by spacers 66. The stack 62 is surrounded by a pair of straps 68 and 70 combined to coil springs 72 and 74. When the height of the pile warrants and extra rigidity of the bundle is needed, the stack 62 is subdivided in two superposed bundles by a pair of logs 76 and 78. As for the stack 42, the boards of the stack 62 are originally piled up horizontally, strapped and then raised in a vertical position over a perforated platform 80 which can be wheeled in the enclosure 40.

It should be understood that although two different types are described to be located in the enclosure 40, the latter can accept two similar types of stacked boards.

The enclosure 40 has an insulation layer 82 around its periphery and is provided along its inner surface with top heating coils 84, side coils 86 and bottom coils 88.

Once the desired temperature of the dry heat supplied by the heating coils 84, 86 and 88 has been reached according to the process explained relative to FIGS. 1, 2 and 3, only the bottom coils 88 remain electrically connected. While the walls of the enclosure 40 are insulated, the ones which are not heated, such as the side-walls, remain cooler than the center of the enclosure. Accordingly, a definite circulation of the vapor of sap will establish itself. The heated coils 88 favor the vapor to rise through the spaces between the boards and between both stacks 42 and 62. Because the sides of the enclosure 40 are cooler, the vapor will move downwardly therealong. This natural circulation is slow and favors an even distribution of heat. The slow movement of the vapor over a maximum surface of the boards will maintain the latter at a relatively even temperature and in a constant contact with vapor of sap.

Because the edges of the boards 44 and 64 have a tendency to loose their humidity faster, they are preferably disposed in contact, edgewise, as shown in FIGS. 4 and 5.

Although the arrangement shown in FIG. 4 provides an ascending movement of the vapor through the boards, it would also be acceptable to create a descending movement of vapor therethrough. This could be obtained by heating the side heating coils 86.

The process, when carried according to the desired circulation of the vapor explained by FIGS. 4, 5 and 6 provides a more even drying process over the whole surface of the lumber stacked in the enclosure 40.

Although it is preferable to raise the temperature inside the enclosure as fast as possible with all the heating coils 84, 86 and 88, it is also possible to raise the temperature of the enclosure exclusively with the heating coils which will serve the purpose of the proper circulation of the vapor of sap.

What I claim is:

1. A process for decreasing the moisture content in wood which comprises the following consecutive steps:

a. placing the wood in an enclosure and introducing vapor made essentially of sap in said enclosure until the center of the wood has substantially reached the temperature of the vapor, b. gradually raising the temperature of the vapor atmosphere to a temperature substantially above the boiling temperature and during a time sufficient to bake the resinous substances inside the wood and to reduce the moisture content to a predetermined percentage, and c. subsequently reducing gradually the temperature of the vapor down to the boiling temperature by the introduction of a vapor of sap, wherein the inside of the enclosure is maintained during the steps of the process at a pressure slightly above the atmospheric pressure.

2. A process for decreasing the moisture content in wood which comprises the following consecutive steps:

a. placing the wood in an enclosure and introducing vapor made essentially of sap in said enclosure at a temperature slightly above 212°F and at a pressure slightly above the atmospheric pressure during a period sufficient to raise the center of the wood at the temperature of the vapor, b. gradually increasing the temperature of the vapor to about 300°F while increasing the quantity of vapor to maintain the same pressure, c. supplying dry heat to gradually increase the temperature inside the housing until the humidity is eliminated to a desired percentage inside the wood while maintaining approximately the same surrounding pressure, d. introducing vapor of sap at a temperature of 212°F for maintaining the pressure until the temperature inside the housing has substantially reached the temperature of the vapor introduced, and e. subsequently rendering the wood at the room temperature and at the atmospheric pressure.

3. A process as recited in claim 2, in which the vapor is made out of saturated sap.

4. A process according to claim 3, wherein the original vapor produced in the housing comprises sap corresponding to the treated wood.

5. A process according to claim 2, wherein the pressure is substantially ¼ pound per square inch above atmospheric pressure.

6. A process according to claim 2, wherein the temperature of the (c) step is raised to about 500°F.

7. A process as recited in claim 2, wherein the heat in the housing is produced by electrical heating elements.

8. A process according to claim 7 in which the electrical elements are mounted on the walls of the housing.

9. A process as recited in claim 2, wherein the wood is essentially constituted of elongated boards, the said process comprises, disposing the wood boards in a vertical position, the said boards being laterally spaced apart to form vertical chimney-like channels for the vertical movement of the vapor of sap therethrough.

10. A process as recited in claim 9, wherein the boards are disposed in vertical stacks with spacers between the boards, the said stacks being resiliently strapped to prevent bending of the boards while adapting to small expansion and contracting dimensional changes of the wood boards.

11. A process as recited in claim 10, wherein the wood boards have a rectangular cross-section, the said boards being disposed side by side to abut on their short sides, wherein essentially only their long sides are exposed to vapor of sap.

12. A process as recited in claim 9, wherein dry heat is supplied as stated in paragraph (a) of claim 2, so as to create a vertical circulation of vapor of sap.

13. A process as recited in claim 12, wherein heating elements are located below the wood stacks to create an ascending movement of the vapor of sap in the said channels.

* * * * *